US010924859B2

(12) United States Patent
Fong et al.

(10) Patent No.: US 10,924,859 B2
(45) Date of Patent: Feb. 16, 2021

(54) SOUND SHAPING APPARATUS

(71) Applicant: PPIP LLC, Chandler, AZ (US)

(72) Inventors: Michael Fong, Chandler, AZ (US); Neric Hsin-wu Fong, Tempe, AZ (US); Teddy David Thomas, Bedford, NH (US)

(73) Assignee: PPIP, LLC, Chandler, AZ (US)

( * ) Notice: Subject to any disclaimer, the term of this patent is extended or adjusted under 35 U.S.C. 154(b) by 0 days.

(21) Appl. No.: 16/983,780

(22) Filed: Aug. 3, 2020

(65) Prior Publication Data

US 2020/0366993 A1 Nov. 19, 2020

Related U.S. Application Data

(63) Continuation of application No. 16/272,946, filed on Feb. 11, 2019, now Pat. No. 10,757,507.

(60) Provisional application No. 62/630,128, filed on Feb. 13, 2018.

(51) Int. Cl.

| | |
|---|---|
| ***H04R 5/04*** | (2006.01) |
| ***H04R 3/04*** | (2006.01) |
| ***H04R 3/12*** | (2006.01) |
| ***H04R 3/00*** | (2006.01) |
| ***G10L 21/0232*** | (2013.01) |
| ***G10L 21/0388*** | (2013.01) |

(52) U.S. Cl.

CPC ..... *H04R 5/04* (2013.01); *G10L 21/0232* (2013.01); *G10L 21/0388* (2013.01); *H04R 3/005* (2013.01); *H04R 3/04* (2013.01); *H04R 3/12* (2013.01)

(58) Field of Classification Search

CPC . H04R 5/04; H04R 3/005; H04R 3/00; H04R 3/04; H04R 3/12; H04R 2205/024; G10L 21/0232; G10L 21/0388

See application file for complete search history.

(56) References Cited

U.S. PATENT DOCUMENTS

| | | | | |
|---|---|---|---|---|
| 5,732,143 A * | 3/1998 | Andrea | G10K 11/178 381/71.6 |
| 7,260,221 B1 * | 8/2007 | Atsmon | G06F 21/35 380/247 |
| 7,346,654 B1 * | 3/2008 | Weiss | H04N 7/15 348/E7.083 |
| 9,525,765 B2 * | 12/2016 | Moser | H04R 1/083 |
| 10,074,353 B2 * | 9/2018 | Cook | H04K 3/43 |

(Continued)

FOREIGN PATENT DOCUMENTS

| | | | |
|---|---|---|---|
| JP | 2006267174 A * | 10/2006 | G10K 11/175 |
| JP | 2006267174 A | 10/2006 | |

*Primary Examiner* — Yogeshkumar Patel

(74) *Attorney, Agent, or Firm* — Fernando & Partners, LLP

(57) ABSTRACT

In accordance with some embodiments, an apparatus for privacy protection is provided. The apparatus includes an audio output device arranged to output sound directed to an audio input device of a second device. The apparatus further includes an audio coupling interface arranged to provide a cavity for the audio output device and the audio input device of the second device. The apparatus also includes a spectral shaper, coupled to the audio output device, operable to apply a spectral envelope to an audio signal in order to produce a shaped audio signal, wherein the shaped audio signal is selectively coupled to the audio output device.

20 Claims, 7 Drawing Sheets

(56) References Cited

U.S. PATENT DOCUMENTS

2003/0091199 A1* 5/2003 Horrall ..... H04K 3/825
381/73.1
2003/0219133 A1* 11/2003 Horrall ..... H04R 3/12
381/73.1
2006/0136544 A1* 6/2006 Atsmon ..... A63H 3/28
709/200
2008/0281588 A1* 11/2008 Akagi ..... G10K 11/1754
704/223
2009/0067291 A1* 3/2009 Atsmon ..... G06F 21/35
367/118
2010/0030838 A1* 2/2010 Atsmon ..... A63H 3/28
709/200
2011/0103614 A1* 5/2011 Cheung ..... H04R 1/403
381/94.1
2011/0182445 A1* 7/2011 Atsmon ..... G06F 21/35
381/123
2014/0006017 A1* 1/2014 Sen ..... H04S 7/30
704/208
2014/0064526 A1* 3/2014 Otto ..... H04S 5/00
381/300
2015/0271341 A1* 9/2015 Kleiner ..... H04W 12/0608
455/411
2016/0041808 A1* 2/2016 Pelland ..... H04R 3/00
381/123
2018/0115839 A1* 4/2018 Eichfeld ..... H04R 5/027

* cited by examiner

SOUND SHAPING APPARATUS

CROSS-REFERENCE TO RELATED APPLICATION

This application is a continuation of U.S. patent application Ser. No. 16/272,946 filed on Feb. 11, 2019, which further claims priority to U.S. provisional patent application No. 62/630,128 filed on Feb. 13, 2018, the contents of which are hereby incorporated by reference.

TECHNICAL FIELD

This relates generally to the field of privacy protection, and more specifically to an apparatus for shaping audio masking signal.

BACKGROUND

Smartphones have sensors for collecting information of or about a user. For example, microphones on smartphones can be used to record a user's conversation. Often, smartphones also have radios for local or remote communications, e.g., a cellular radio, a WiFi radio, and/or a Bluetooth radio. Together, the sensors and radios can reveal a wealth of user information to third parties, e.g., the third parties can eavesdrop from a remote location with the help of the microphones and communication devices. Currently, smartphones are not capable of masking the recorded audio signals. Accordingly, smartphones are inadequate in user privacy protection.

BRIEF DESCRIPTION OF THE DRAWINGS

So that the present disclosure can be understood by those of ordinary skill in the art, a more detailed description can be had by reference to aspects of some illustrative embodiments, some of which are shown in the accompanying drawings.

Figure 1:
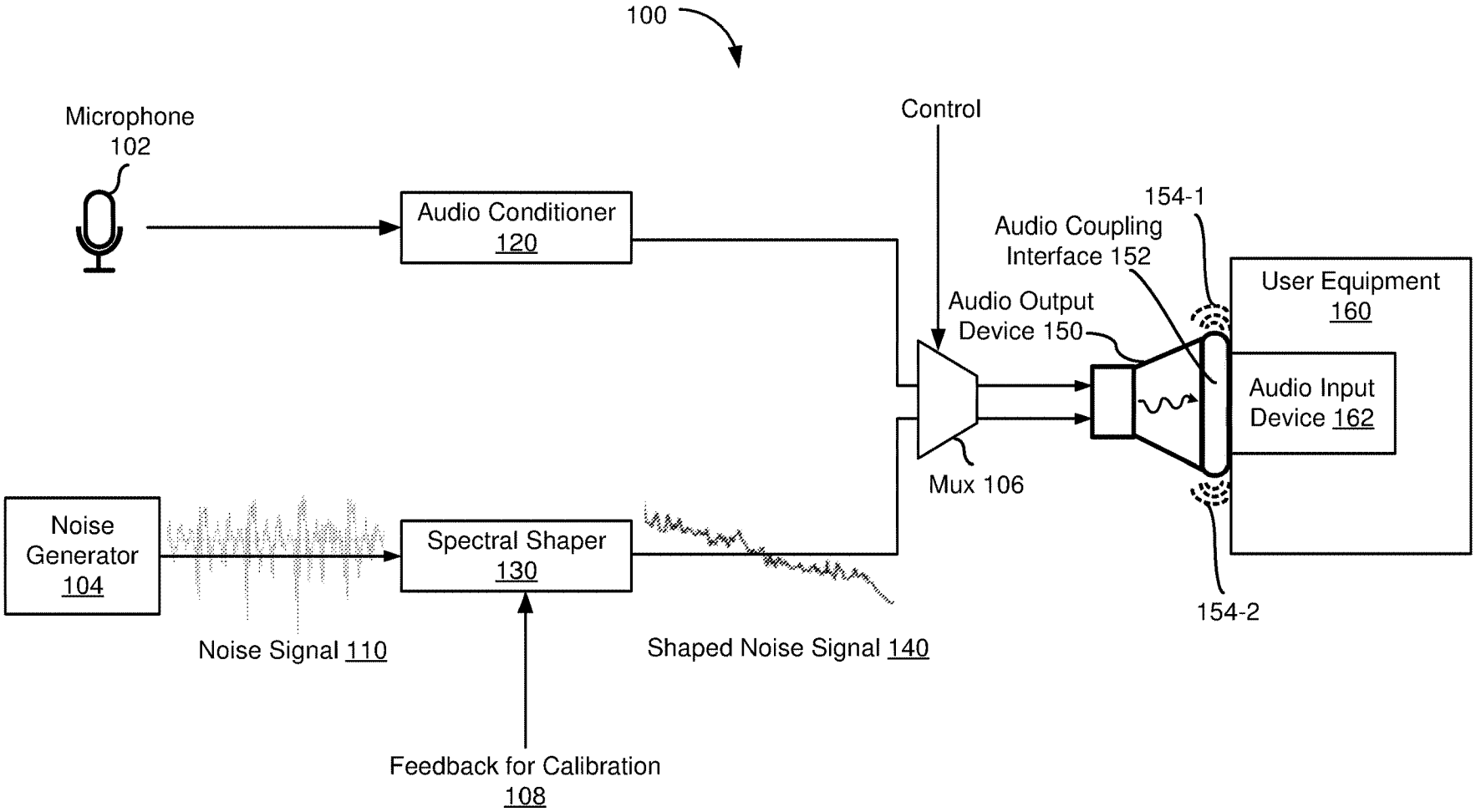
FIG. 1 is a block diagram of an exemplary system for shaping audio signal in accordance with some embodiments.

In accordance with common practice the various features illustrated in the drawings cannot be drawn to scale. Accordingly, the dimensions of the various features can be arbitrarily expanded or reduced for clarity. In addition, some of the drawings cannot depict all of the components of a given system, method or device. Finally, like reference numerals can be used to denote like features throughout the specification and figures.

DETAILED DESCRIPTION

Accordingly, described herein is an apparatus (also known as a smart case or a sound shaping apparatus) for providing a shaped audio masking signal to audio input devices on user equipment, e.g., to microphones on a personal communication device. In some embodiments, the apparatus includes an audio output device (e.g., a speaker) that outputs sound directed to an audio input device of the user equipment being protected by the apparatus. The audio output device is mated with the audio input device through an audio coupling interface (e.g., an audio seal). In some embodiments, the audio coupling interface provides a cavity for the audio output device and the audio input device, such that the physical barrier provided by the audio coupling interface attenuates sound in both directions. For example, in one direction, the ambient sound from outside the cavity is attenuated before reaching the microphone on the user equipment; and in the other direction, the masking signal from inside the cavity is attenuated in order to reduce the obtrusiveness of leaky masking signals. In some embodiments, to further reduce the obtrusiveness of the leaky masking signal, the apparatus includes a spectral shaper to apply a spectral envelope to an audio signal (e.g., the masking signal). By applying the spectral envelope, the spectral shaper produces a shaped audio signal to be selectively coupled to the audio output device. The shaped audio signal has characteristics that are less obtrusive to the surroundings. Thus, the apparatus disclosed herein reduces the obtrusiveness of the masking signal to the environment, while maintaining the effectiveness of the masking signal.

In accordance with some embodiments, the apparatus comprises an audio output device that is arranged to output sound directed to an audio input device of a second device. In some embodiments, the apparatus further includes an audio coupling interface arranged to provide a cavity for the audio output device and the audio input device of the second device. In some embodiments, the apparatus also includes a spectral shaper that is coupled to the audio output device, the spectral shaper being operable to apply a spectral envelope to an audio signal in order to produce a shaped audio signal, wherein the shaped audio signal is selectively coupled to the audio output device.

In accordance with some embodiments, a device includes one or more processors, non-transitory memory, and one or more programs; the one or more programs are stored in the non-transitory memory and configured to be executed by the one or more processors, and the one or more programs include instructions for performing or causing performance of the operations of any of the methods described herein. In accordance with some embodiments, a non-transitory computer readable storage medium has stored therein instructions which, when executed by one or more processors of a device, cause the device to perform or cause performance of the operations of any of the methods described herein. In accordance with some embodiments, a device includes means for performing or causing performance of the operations of any of the methods described herein.

Reference will now be made in detail to embodiments, examples of which are illustrated in the accompanying drawings. In the following detailed description, numerous specific details are set forth in order to provide a thorough understanding of the various described embodiments. However, it will be apparent to one of ordinary skill in the art that the various described embodiments may be practiced without these specific details. In other instances, well-known methods, procedures, components, circuits, and networks have not been described in detail so as not to unnecessarily obscure aspects of the embodiments.

It will also be understood that, although the terms first, second, etc. are, in some instances, used herein to describe various elements, these elements should not be limited by these terms. These terms are only used to distinguish one element from another. For example, a first contact could be termed a second contact, and, similarly, a second contact could be termed a first contact, without departing from the scope of the various described embodiments. The first contact and the second contact are both contacts, but they are not the same contact, unless the context clearly indicates otherwise.

The terminology used in the description of the various described embodiments herein is for the purpose of describing particular embodiments only and is not intended to be limiting. As used in the description of the various described embodiments and the appended claims, the singular forms "a", "an", and "the" are intended to include the plural forms as well, unless the context clearly indicates otherwise. It will also be understood that the term "and/or" as used herein refers to and encompasses any and all possible combinations of one or more of the associated listed items. It will be further understood that the terms "includes", "including", "comprises", and/or "comprising", when used in this specification, specify the presence of stated features, integers, steps, operations, elements, and/or components, but do not preclude the presence or addition of one or more other features, integers, steps, operations, elements, components, and/or groups thereof.

As used herein, the term "if" is, optionally, construed to mean "when", "upon", "in response to determining", or "in response to detecting", depending on the context. Similarly, the phrase "if it is determined" or "if [a stated condition or event] is detected" is, optionally, construed to mean "upon determining", "in response to determining", "upon detecting [the stated condition or event]," or "in response to detecting [the stated condition or event]," depending on the context.

It should be appreciated that in the development of any actual embodiments (as in any development project), numerous decisions must be made to achieve the developers' specific goals (e.g., compliance with system and business-related constraints), and that these goals will vary from one embodiment to another. It will also be appreciated that such development efforts might be complex and time consuming, but would nevertheless be a routine undertaking for those of ordinary skill in the art of image capture having the benefit of this disclosure.

Referring to FIG. 1, FIG. 1 depicts a simplified block diagram of a system 100 providing a shaped audio signal, in accordance with some embodiments. In some embodiments, the system 100 includes a spectral shaper 130 that receives a noise signal 110 and produces a shaped noise signal 140. In some embodiments, the system 100 also includes an audio conditioner 120 that conditions the audio signal captured by a microphone 102. In some embodiments, the system 100 includes an audio output device 150 (e.g., a loudspeaker, an electromechanical component such as a piezoelectric element, or an air conduction speaker) that outputs sound directed to an audio input device 162 of a second device 160 (e.g., a user equipment). In some embodiments, the sound coupled to the audio output device 150 is selected from the output of the audio conditioner 120 and/or the spectral shaper 130 by a switch (or a multiplexer) 106. In some embodiments, as described in detail below with reference to FIG. 3, the switch 106 is controlled by a digital signal processor. The system 100 further includes an audio coupling interface 152 that attenuates sound. It should be noted that while the aforementioned features and components are illustrated, those of ordinary skill in the art will appreciate from the present disclosure that various other features and components have not been illustrated for the sake of brevity and so as not to obscure more pertinent aspects of the embodiments disclosed herein. Also, those of ordinary skill in the art will appreciate from the present disclosure that the functions of the components described below can be combined into one or more components and/or further subdivided into additional sub-components; and, that the components described below are provided as exemplary configuration of the various aspects and functions described herein.

To that end, as a non-limiting example, in some embodiments, the system 100 includes an audio input device 102 (e.g., a microphone) providing audio signal to the audio conditioner 120 and a noise generator 104 providing the noise signal 110 to the spectral shaper 130. In some embodiments, the audio input device 102 records ambient sound from the surroundings. The ambient sound (including voice conversations) as the audio signal 110 is conditioned by the audio conditioner 120. For example, the audio signal 110 can be conditioned to sound like a voice pattern different from the voice pattern of the user of the system 100. As a result, it is more difficult to identify or extra information related to the user based on the conditioned audio signal.

In some embodiments, the noise generator 104 provides noise signal 110 to the spectral shaper 130. In some embodiments, the noise signal 110 can be mixed with the sound recorded by the audio input device 102 and the mixed signal are then coupled to the audio output device 150. As such, the sound recorded by the audio input device 102 is masked and not identifiable or intelligible for privacy protection. In some embodiments, the noise signal 110 from the noise generator 104 is associated with a random (or pseudo-random) number sequence. In some embodiments, the noise signal 110 is generated within a digital signal processor (DSP), field programmable gate array (FPGA), application-specific integrated circuit (ASIC), microprocessor, and/or by the firmware/software (e.g., through the use of pseudo random number generators and/or algorithms such as AES encryption with various key lengths etc.). In other embodiments, the noise signal 110 is generated by external or dedicated electronic components, such as a diode or a resistor that generates electronic noise. In some embodiments, the noise signal 110 is generated by applying power to the resistor and/or by the diode in breakdown mode and measuring and/or sampling the noise created. In some embodiments, the noise signal 110 can be used as a random seed to generate multiple uncorrelated audio signal streams, e.g., by re-using the same seed or sampling such seed at pre-determined or randomized intervals to produce uncorrelated noise signal streams for masking two or more audio input devices. As used herein, a random seed is a number (or vector) used to initialize a random or pseudorandom number generator.

In some embodiments, the spectral shaper 130 processes the noise signal 110, including obtaining a spectral envelope with target spectral characteristics and applying the spectral envelope in order to modify the spectral characteristics of the noise signal 110. In some embodiments, the spectral shaper 130 receives feedbacks 108 for calibration. The spectral shaper 130 realizes a desired output frequency response through the feedback loop 108. The spectral shaper 130 is further described in detail below with reference to FIGS. 4A-4B and 5A-5D. Connectable to the spectral shaper 130, the audio output device 150 (e.g., the speaker) receives the shaped noise signal 140 and outputs audio sound as a function of the shaped noise signal 140. The audio sound outputted by the audio output device 150 (e.g., the speaker) is directed to the audio input device 162 through the audio coupling interface 152.

In some embodiments, the audio coupling interface 152 mates the audio output device 150 with the audio input device 162. The audio coupling interface 152 can be made of audio seals, structures, baffles, and/or sound isolating techniques known in the art to help reduce external audio energy from reaching the audio input device 162. In some embodiments, mechanical or electro-mechanical mechanism known in the art can be used to apply the audio coupling interface 152 to its mated surface. In some embodiments, differing compression levels based on the surface material of the user equipment 160 can be used for the audio coupling interface 152 in order to form an audio-sealing pathway. The audio coupling interface 152 reduces the amount of leaked sound 154-1 and 154-2 from escaping the audio-sealing pathway and reduces the amount of ambient sound from entering the audio-sealing pathway.

Figure 2:
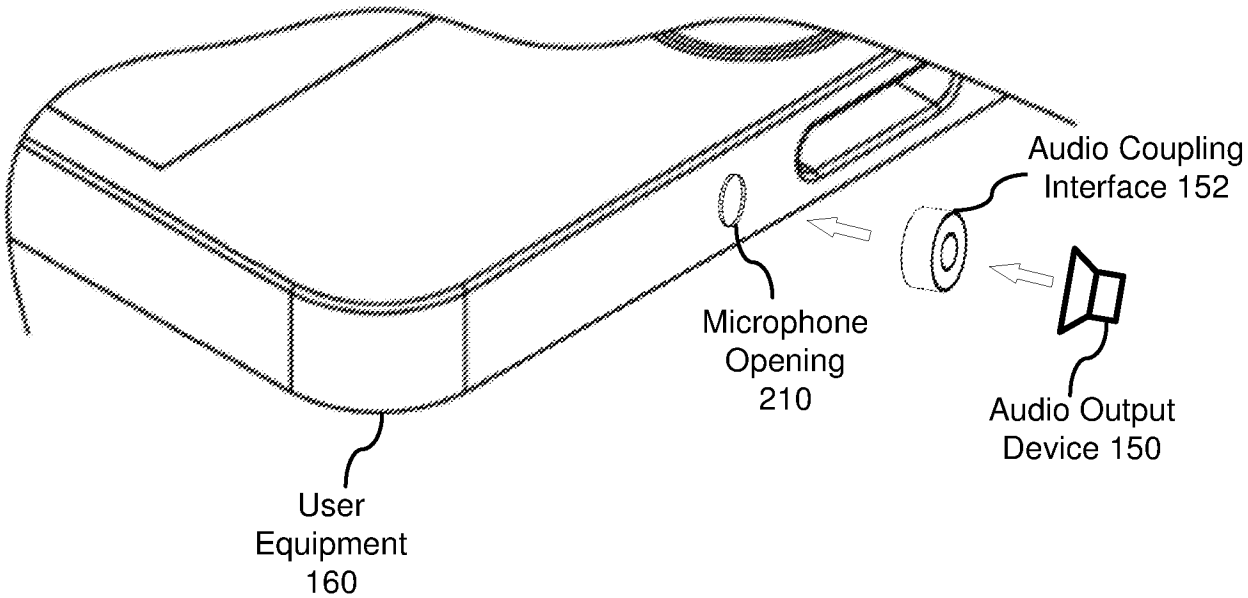
FIG. 2 is a cross-section of an audio coupling interface with an audio-sealing pathway in accordance with some embodiments.

For example, FIG. 2 shows a cross-section of the audio coupling interface 152 that forms part of an audio-sealing pathway. The audio coupling interface 152 mates the audio output device 150 (e.g., a speaker) with the audio input device 162 (FIG. 1) of the user equipment 160. In some embodiments, the audio coupling interface 152 is shaped to optimize the acoustical coupling to a targeted audio input device 162. This can be achieved by taking into account various factors including, but not limited to, the space available for the audio coupling interface 152, the surface material of the user equipment 160 or the audio output device 150, texture and form of an interface to which the seal can mate, the acoustical path by which the targeted audio input device 162 detects audio content, and/or the level of sealing specified to meet the desired level of attenuation.

In FIG. 2, as a non-limiting example, the audio coupling interface is positioned between the audio input device 162 and the audio output device 150. In order to cover a round opening 210 on the user equipment 160, behind which the audio input device 162 (e.g., a microphone) is mounted, the audio coupling interface 152 has a cut-out surrounded by wall. The cut-out forms a cavity or a chamber inside the wall in a shape of pipe, tube, or tunnel, and the cavity serves as part of the audio-sealing pathway for the audio signal from the audio output device 150 to the audio input device 162. In some embodiments, the cavity is in the shape of cone, horn, or trumpet so that it amplifies the audio signal directed at the audio input device 162. In some embodiments, the audio coupling interface 152 is made of foam material (e.g., polymer foam), flexible or compliant flexible material (e.g., elastomer, neoprene etc.), so that it seals the area surrounding the microphone opening 210. While allowing and facilitating the passing of the sound from the audio output device 150 to the audio input device 162, the sealing provided by the audio coupling interface 152 attenuates sound from entering the cavity and attenuates sound from leaking out of the cavity (e.g., the leaked sound 154, FIG. 1).

Though FIGS. 1 and 2 illustrate sound shaping for one audio input device 162, as will be shown in FIG. 3 and described in detail below, the spectral shaper 130 can provide sound shaping for a plurality of audio input devices, in accordance with some embodiments. In such embodiments, a plurality of audio output devices is arranged to output uncorrelated signal directed to a plurality of audio input devices of the user equipment 160; a plurality of audio coupling interfaces is arranged to mate the audio output devices to the audio input devices of the user equipment 160; and the spectral shaper 130 is coupled to the plurality of audio output devices and operable to apply the spectral envelope to the uncorrelated audio signal in order to produce shaped uncorrelated audio signal.

Figure 3:
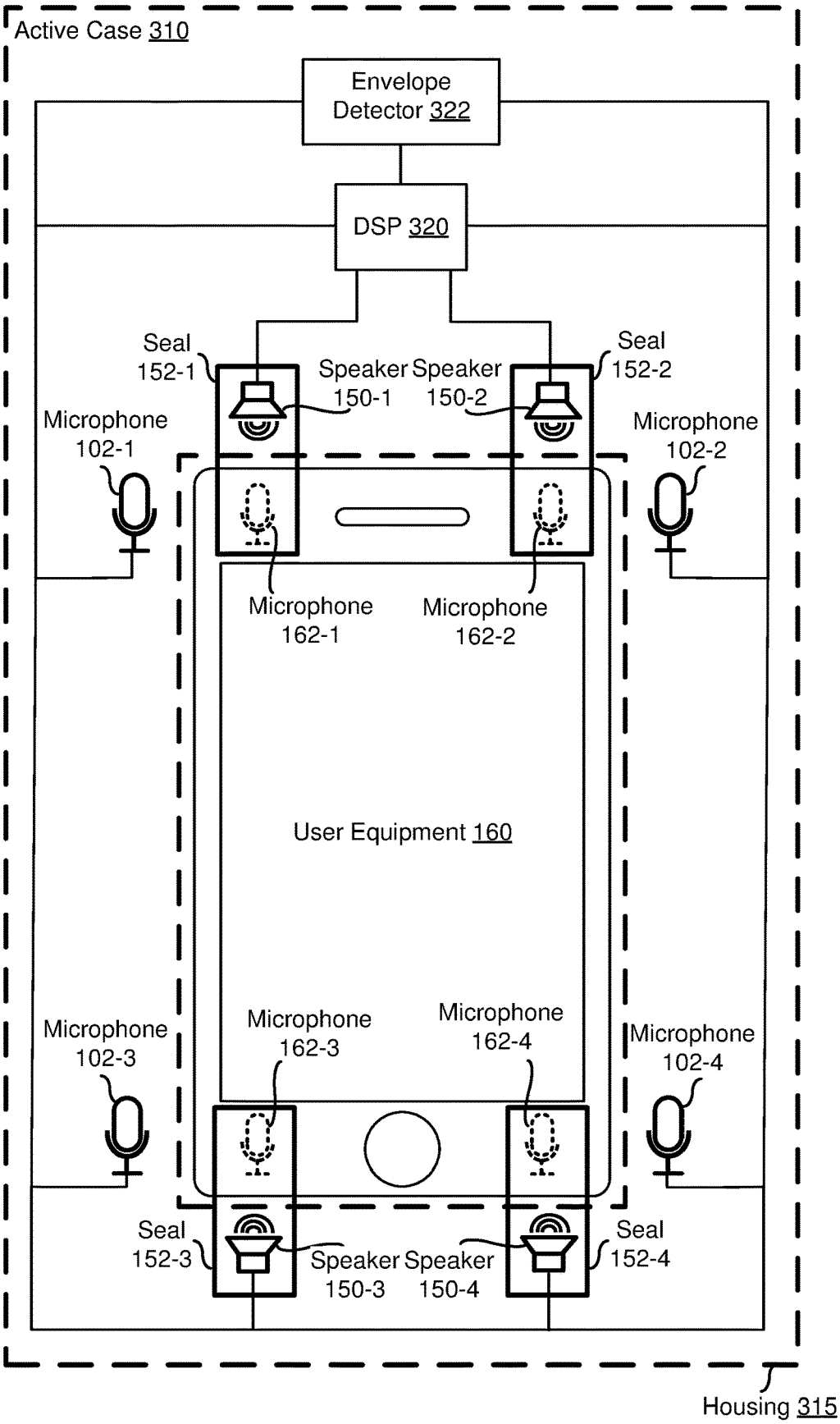
FIG. 3 is an illustration of an exemplary sound shaping apparatus in accordance with some embodiments.

Turning to FIG. 3, FIG. 3 is a simplified block diagram of a sound shaping apparatus 310 (also known as an "active case") that shapes audio signal, in accordance with some embodiments. In some embodiments, the active case 310 includes a housing 315 that receives and holds a second device, e.g., the user equipment 160. In some embodiments, the user equipment 160 includes one or more audio input devices, e.g., the microphones 162-1, 162-2, 162-3, and 162-4. In some embodiments, the active case 310 includes one or more audio output devices (e.g., the speakers 150-1, 150-2, 150-3, and 150-4) arranged to output sound directed to the microphones 162. In some embodiments, the active case 310 includes one or more audio coupling interfaces (e.g., the audio seals 152-1, 152-2, 152-3, and 152-4), each providing part of an audio-sealing pathway for passing the audio signals from the audio output device 150 of the active case 310 to the audio input device 162 of the user equipment 160. In some embodiments, the active case 310 includes a digital signal processor (DSP) 320 providing at least the sound shaping function. It should be noted that while the aforementioned features and components are illustrated, those of ordinary skill in the art will appreciate from the present disclosure that various other features and components have not been illustrated for the sake of brevity and so as not to obscure more pertinent aspects of the embodiments disclosed herein. For example, though FIG. 3 shows the active case 310 protects four microphones 162-1, 162-2, 162-3, and 162-4 on the user equipment 160, a plurality of (e.g., more than four or less than four) microphones of the user equipment 160 can be protected by the active case 310 described herein. Also, those of ordinary skill in the art will appreciate from the present disclosure that the functions of the components described below can be combined into one or more components and/or further sub-divided into additional sub-components; and, that the components described below are provided as exemplary configuration of the various aspects and functions described herein.

To that end, as a non-limiting example, in some embodiments, the housing 315 is a housing assembly. In some embodiments, the housing assembly further includes sub-assemblies, e.g., a plurality of both moveable parts and non-moveable parts that can form an enclosure when assembled together. The housing 315 thus allows a user to insert the user equipment 160 into the active case 310 for more protection of sensitive information (e.g., in a work mode) or take the user equipment 160 out of the active case 310 for less monitoring of the personal communication by a business organization (e.g., in a personal mode). In some embodiments, the housing assembly also causes the DSP 320 to selectively couple the shaped audio signal to the speaker 150 of the active case 310. In other words, by pressing a button at least partially supported by the housing assembly or changing the hood position, the DSP 320 generates and provides different control signals to the switch 106 (FIG. 1) to place the active case 310 in different mode of operation. For example, in one mode of operation, the audio path including the noise generator 104 (FIG. 1), the spectral shaper 130 (FIG. 1), and the speaker 150 is established through the control of the switch 106 (FIG. 1), so that the shaped noise signal is coupled to the speaker 150. In a different mode of operation, the audio path including the microphone 102, the audio conditioner 120 (FIG. 1), and the speaker 150 is established through the control of the switch 106 (FIG. 1), so that the modified voice signal is coupled to the speaker 150.

In some embodiments, the sub-assemblies include a base and a hood assembly that is moveable. In some embodiments, when the hood assembly is in a first position (e.g., hood down/lowered or clamped), the active case 310 is in a first mode of operation (e.g., a privacy protection mode or a work mode). On the other hand, when the hood assembly is in a second position (e.g., hood up or unclamped), the active case 310 is in a second mode of operation (e.g., an unprotected mode or a personal mode). When the active case 310 is in the first mode of operation (e.g., the work mode), the hood assembly coordinated with the base engages the audio seals 152 to mate the speakers 150 with the microphones 162. Once engaged, the audio seals 152 provide parts of audio-sealing pathways between the speakers 150 and the microphones 162. In some embodiments, a button at least partially supported by the housing 315 is provided to turn on or off the sound masking function, so that the active case 310 selectively couples the shaped audio signal to the speakers 150.

In some embodiments, at least the audio output device 150 is connectable to the user equipment 160. For example, the speaker 150 is clipped on a smart device and the audio seal 152 is coupled to the opening of the microphone 162 of the user equipment 160 to seal the audio-sealing pathway between the speaker 150 and the microphone 162.

In some embodiments, the user can activate, deactivate, tune or change the level, volume, power or capabilities of the electronic audio repeating and/or masking capability through the use of switches, buttons or other such physical interface included in or at least partially supported by the housing 315, so that the active case 310 can selectively couple the shaped audio signal to the speakers 150. In some other embodiments, such features or capabilities can be activated, deactivated, tuned or changed by movements, motion, remote control(s) such as radio frequency (RF), infrared, or other wired or wireless technology or sound such as a spoken keyword or phrase. In some embodiments of the invention, the use of electronic audio repeating, manipulation, jamming, masking, attenuating, and/or blocking can provide features or capabilities beyond audio protection, such as amplification, audio enhancement, noise or echo canceling, audio mixing and other forms of audio manipulation to name a few.

In some embodiments, the speakers 150 output sound generated based on the shaped audio signal. The sound is passed to the microphones 162 along the audio-sealing pathway, including passing through the cavity inside the audio seals 152. Through the audio seals 152, the speakers 150 are mated with the microphones 162, e.g., the audio seal 152-1 mates the speaker 150-1 with the microphone 162-1, the audio seal 152-2 mates the speaker 150-2 with the microphone 162-2, the audio seal 152-3 mates the speaker 150-3 with the microphone 162-3, and the audio seal 152-4 mates the speaker 150-4 with the microphone 162-4. In some embodiments, one end of each audio-sealing pathway is the speaker 150 on the active case 310, e.g., the audio seal 152 is made of flexible materials such that it extends from the surrounding edge of the speaker membrane. In some embodiments, the other end of each audio-sealing pathway covers a respective microphone 162 (or the opening of the respective microphone 210 as shown in FIG. 2) on the user equipment 160. In some embodiments, the end of the audio-sealing pathway is cone, horn, or trumpet shaped to better direct the audio signal to the microphone 162 of the user equipment 160.

As described above with reference to FIGS. 1 and 2, the physical barrier surrounding the audio-sealing pathway attenuates outside sound from reaching the protected device's microphone(s) 162. The physical barrier thus provides privacy protection by reducing the sound captured by the microphones 162. Further, as described above with reference to FIGS. 1 and 2, the physical barrier surrounding the audio-sealing pathway reduces the amount of masking signal reaching outside the audio seals 152 (e.g., a small amount of leaked masking signal 154, FIG. 1), thereby reducing the detectability and/or obtrusiveness of such signal to the outside environment.

In some embodiments, the one or more audio seals 152 can remain stationary relative to the housing 315. In some other embodiments, the one or more audio seals 152 can be moveable, thus sealing and unsealing the sealing path at different points in time. In some embodiments, the ability to seal or unseal one or more microphones 162 of the user equipment 160 is available on a microphone-by-microphone basis.

In some embodiments, to further reduce the detectability and/or obtrusiveness of the leaked audio signal, the DSP 320 shapes the audio signal prior to outputting the shaped audio signal by the speakers 150. Embodiments of the DSP 320 include hardware, software, firmware, or a combination thereof. In some embodiments, the DSP 320 executes instructions stored in non-transitory memory to perform at least certain functions of noise source generation (e.g., the instructions for the noise generator 104) and sound shaping (e.g., the instructions for the spectral shaper 130, FIG. 1). The sound shaping function performed by the DSP 320 includes shaping the audio signal to a certain frequency and/or amplitude so that the leaked audio signal would be less obtrusive to human ears and/or more difficult for a third-party to extract information from.

In some embodiments, to reduce the detectability of the leaked audio signal, the DSP 320 instructs different audio output devices 150 to play different audio content (e.g., pass-through, noise, modified, processed, manipulated or otherwise changed content) for different microphones 162. As such, the audio content played is uncorrelated, and thus it is more difficult to derive the protected audio content (e.g., through elaborated efforts), such as by comparing the audio signals from different microphones 162.

In some embodiments, the active case 310 also includes a plurality of audio input devices of its own, e.g., the microphones 102-1, 102-2, 102-3, and 102-4. The microphones 102 are at least partially supported by the housing 315. In some embodiments, the microphones 102 record sound independently of the sound recording by the microphones 162 on the user equipment 160. In some embodiments, the active case 310 transmits the independently recorded sound to an external electronic device through a secure channel for secure communication. Further, the ambient sound (including voice conversations) recorded by the microphones 102 can be shaped by the DSP 320 to obfuscate the ambient sound before being outputted by the audio output device 150 and directed at the audio input device 162 of the user equipment 160. The obfuscation makes it more difficult to derive the audio content from the shaped audio signal.

In some embodiments, an envelope detector 322 derives the sound envelope from the sound recorded by the microphone(s) 102. In some embodiments, the envelope detector 322 is coupled to the microphones 102 and the DSP 320. In some embodiments, the envelope detector 322 is an electronic circuit that takes the audio signal representing the ambient sound recorded by one or more of the microphones 102 as input and provides an output, which is the envelope of the audio signal. The envelope detector 322 thus detects the amplitude variations of the incoming signal. In some embodiments, the envelope detector 322 provides the envelope information to the DSP 320, so that the DSP 320 directs the speakers 150 to adjust the volume of the output masking signal from the speakers 150 appropriate for the level of ambient sound. Though FIG. 3 shows the envelope detector 322 and the DSP 320 as two components, it should be noted that the function of these two components can be combined into one component and/or sub-divided into additional sub-components; and, that the components described herein are provided as exemplary configuration of the various aspects and functions.

Figure 4A:
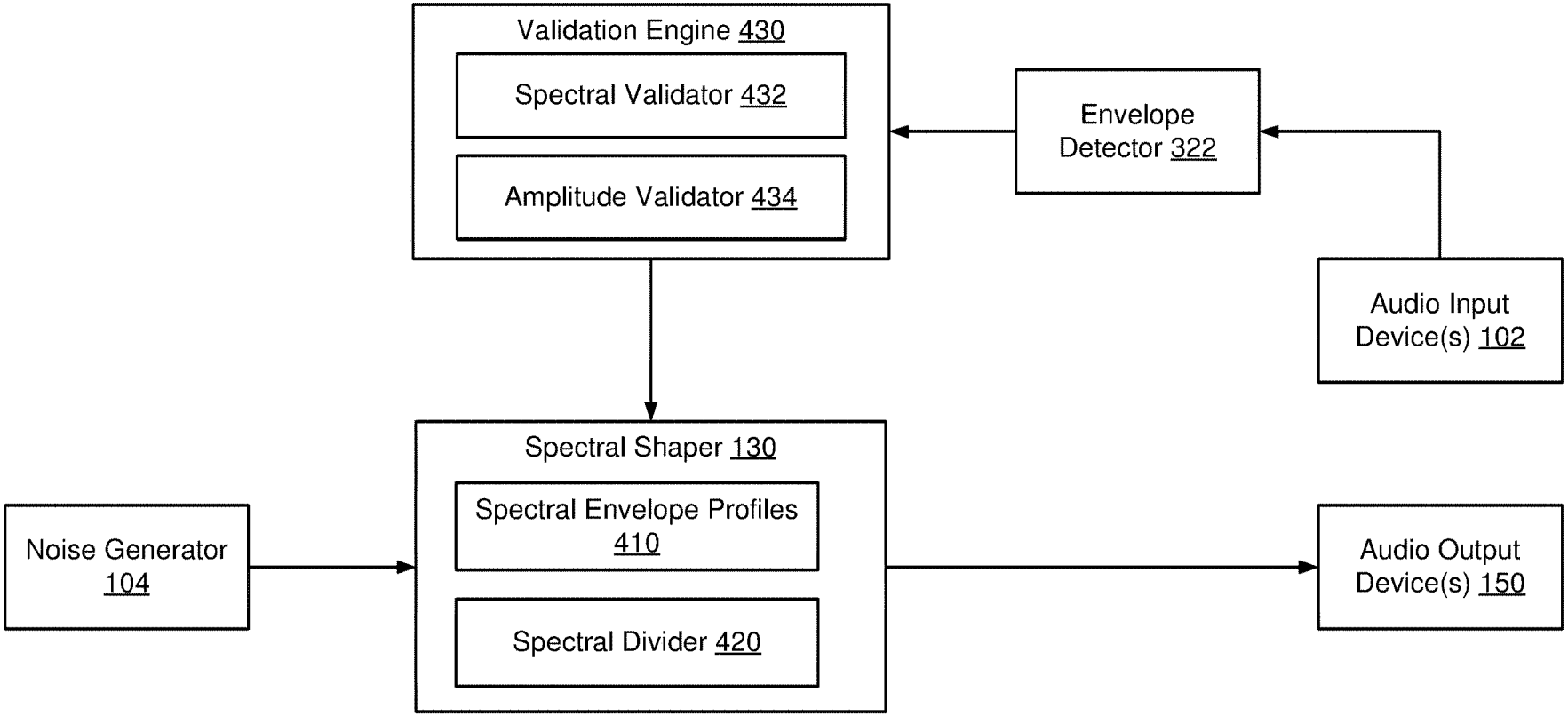
FIGS. 4A and 4B are illustrations of sound shaping utilizing a feedback loop in accordance with some embodiments.

FIG. 4A is a simplified block diagram illustrating the sound shaping by various components utilizing a feedback loop, in accordance with some embodiments. As described above with reference to FIGS. 1 and 3, in some embodiments, the active case 310 includes the noise generator 104 that is a random number generator providing a random or pseudorandom number sequence, the audio input device(s) 102, and the audio output device(s) 150. Also as described above with reference to FIG. 1, in some embodiments, the active case 310 includes the spectral shaper 130 in order to shape the audio signal from the noise generator 104. In some embodiments, the active case 310 also includes a validation engine 430 and the envelope detector 322 in order to provide a feedback loop to the spectral shaper 130. In some embodiments, the spectral shaper 130 further includes spectral envelope profiles 410 and a spectral divider 420. It should be noted that while the aforementioned features and components are illustrated, those of ordinary skill in the art will appreciate from the present disclosure that various other features and components have not been illustrated for the sake of brevity and so as not to obscure more pertinent aspects of the embodiments disclosed herein. Also, those of ordinary skill in the art will appreciate from the present disclosure that the functions of the components described below can be combined into one or more components and/or further sub-divided into additional sub-components; and, that the components described below are provided as exemplary configuration of the various aspects and functions described herein.

To that end, as a non-limiting example, in some embodiments, the spectral shaper 130 is coupled to the audio output device 150. In some embodiments, the spectral shaper 130 maintains the spectral envelope profiles 410. In some embodiments, a spectral envelope profile of the spectral envelope profiles 410 specifies spectral characteristics or other desirable characteristics for audio signal shaping. For example, a spectral envelope profile 410 can comprise frequency patterns of noise (e.g., white, blue, pink, gray, etc.) for shaping the audio signal. In another example, a spectral envelope profile 410 comprises masking signal characteristics corresponding to wind noise, traffic sound, music, or other voice for shaping or morphing the audio signal. In yet another example, a spectral envelope profile 410 specifies audio signal shaping parameters for different frequency bands. In some embodiments, the spectral shaper 130 is programmable, so that the user can activate, deactivate, obtain, or select a spectral envelope profile 410 through the use of switches, buttons or other such physical interface included in or at least partially supported by the housing 315. In some other embodiments, such features or capabilities can be triggered by movements, motion, remote control(s) such as RF, infrared, or other wired or wireless technology or sound such as a spoken keyword or phrase.

In some embodiments, the spectral shaper 130 increases or decreases different frequency bands according to a spectral envelope profile retrieved from the spectral envelope profile 410. In order to shape different frequency bands, in some embodiments, the spectral shaper 130 includes a spectral divider 420 that breaks the audio signal into a set of frequency bands. The spectral shaper 130 then uses a spectral selector to select at least one of the set of frequency bands to apply the spectral envelope corresponding to the retrieved spectral envelope profile 410. As such, different frequency bands are shaped or adjusted according to the parameters specified by the spectral envelope.

Figure 5A:
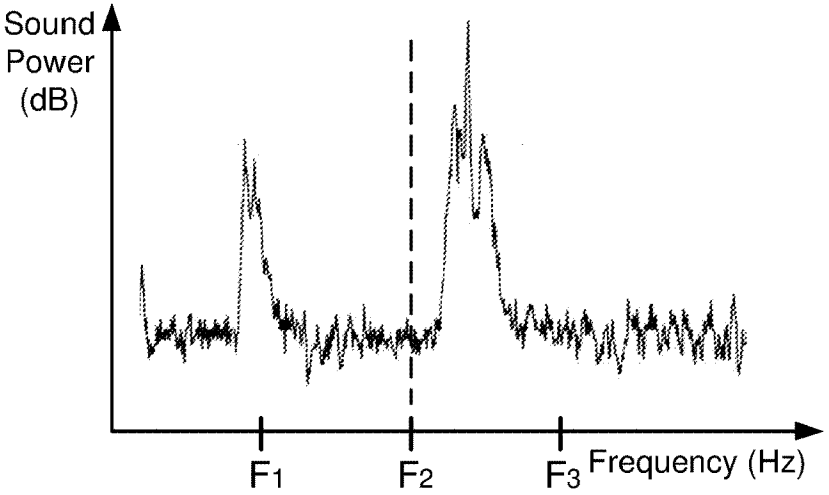
FIGS. 5A-5D are audio signal power and frequency diagrams before and after sound shaping in accordance with some embodiments.

For example, as shown in FIG. 5A, the spectral divider 420 divides the audio signal into a plurality of frequency bands, e.g., F1, F2, F3 etc., with one or more frequency bands in the low frequency range and one or more frequency bands in the high frequency range. As is known in the art, such as the phenomenon of the so-called "skin-effect," the level of attenuation of sound waves is frequency dependent in most materials. Low frequencies are not absorbed as well as high frequencies. As a result, low frequencies travel farther and the amplitude of high frequencies falls off faster. In some embodiments, in a low ambient sound level environment, in order to shorten the traveling distance outside the cavity, the spectral shaper 130 retrieves a spectral envelope profile 410 that specifies reducing the level of low frequency bands to below a threshold. As a result of applying such a spectral envelope, a portion of the audio signal between frequency bands [F1, F2] is shaped to a lower level. The shaped audio signal is shown in FIG. 5B.

Figure 5B:
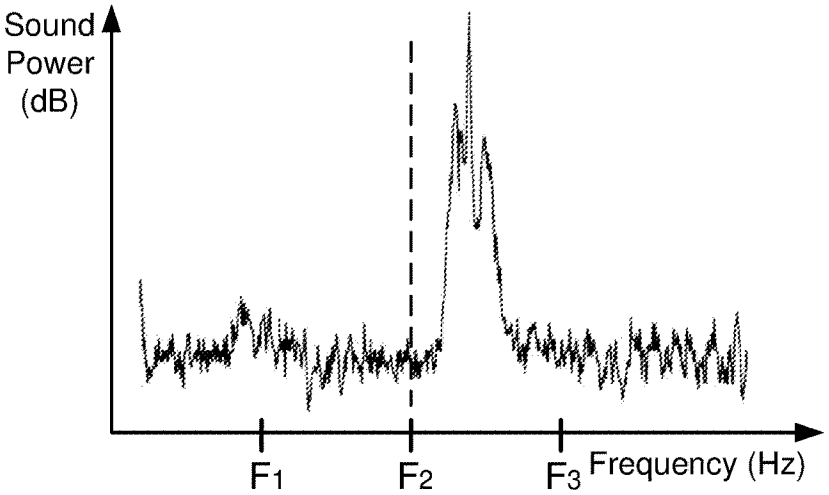
Figure 5C:
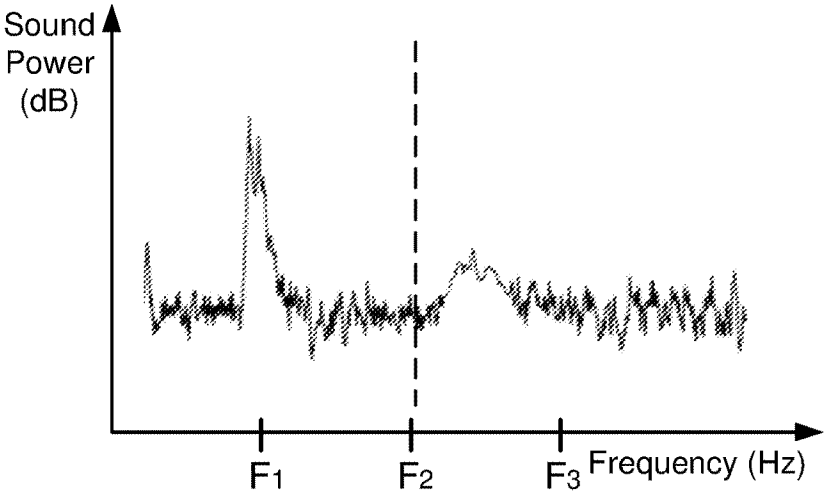

In another example, FIG. 5C illustrates that the spectral shaper 130 applies a spectral envelope corresponding to a spectral envelope profile 410 specifying reducing the level of high frequency bands to below a threshold. As a result of applying such a spectral envelope, a portion of the audio signal between frequency bands [F2, F3] is shaped to a lower level. Since human auditory (e.g., hearing) frequency responses are such that low frequency sound needs to be more intense to sound equally as loud as the higher frequency sound, the shaped audio signal with lowered high frequency portions as shown in FIG. 5C would sound less intensive, and thus less intrusive to human ears.

Figure 5D:
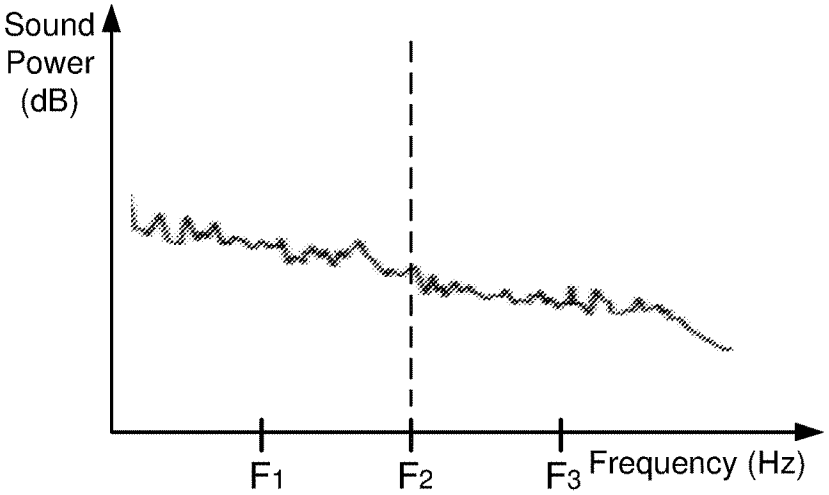

In yet another example, FIG. 5D illustrates shaping an audio signal using a pink noise profile retrieved from the spectral envelope profiles 410. Pink noise profile is desirable due to its low power consumption and effective masking for protection against human speech. Further, the pink noise profile is desirable because it is a less obtrusive and/or noticeable noise profile. It is created by lowering the frequency components/content above certain frequency levels. As a result of applying the pink noise profile, the shaped audio signal as shown in FIG. 5D is less obtrusive.

Though FIGS. 5B-5D illustrate shaping the audio signal with one noise profile from the spectral envelope profiles 410, in some embodiments, more than one noise profiles can be applied to the audio signal shaping. In some embodiments, the noise profile selection is adaptive to the environment in which the active case 310 is operating, so that the shaped audio signal has frequency spectrum characterized by a current operating condition (e.g., the ambient sound level as measured by the envelope detector 322) of the active case 310.

Referring back to FIG. 4A, in some embodiments, the validation engine 430 is coupled to the envelope detector 322 and the spectral shaper 130 to form a feedback loop in order to calibrate the spectral shaper 130. Mechanical (e.g., the audio seal 152, FIGS. 1-3) and electrical components (e.g., the amplifiers, the audio output devices 150, and/or the audio input devices 102 and 162, etc.) have native frequency response. The native frequency response needs to be compensated in order to achieve the desired audio frequency profile. In some embodiments, the spectral shaper 130 is calibrated by sensing and taking the native frequency response measurement followed by correcting the audio signal. In order to provide the feedback, in some embodiments, the validation engine 430 includes a spectral validator 432 and an amplitude validator 434.

In some embodiments, the spectral validator 432 is operable to obtain a frequency response to the audio signal from the envelope detector 322, which is further coupled to the audio input device(s) 102 of the active case 310. The audio input device(s) 102, in some embodiments, captures the audio signal outputted by the audio output device(s) 150 of the active case 310, and provides the audio signal to the envelope detector 322 for measurement. The spectral validator 434 then obtains the measurement from the envelope detector 322 in order to derive the frequency response. The frequency response is then provided to the spectral shaper 130 and causes the spectral shaper 130 to adjust the shaped audio signal as a function of the frequency response.

In some embodiments, the amplitude validator 434 obtains the level of ambient sound from the envelope detector 322. The amplitude validator 434 then compares the level of ambient sound with the level or amplitude of the output noise signal in order to determine whether or not the shaped audio signal is at the appropriate level for masking the ambient sound. Based on the comparison result, in some embodiments, through the coupling with the speakers 150, the amplitude validator 434 directs the speakers 150 to adjust the output sound level in case the output sound level is not appropriate (e.g., too high or too low) for masking ambient sound.

Figure 4B:
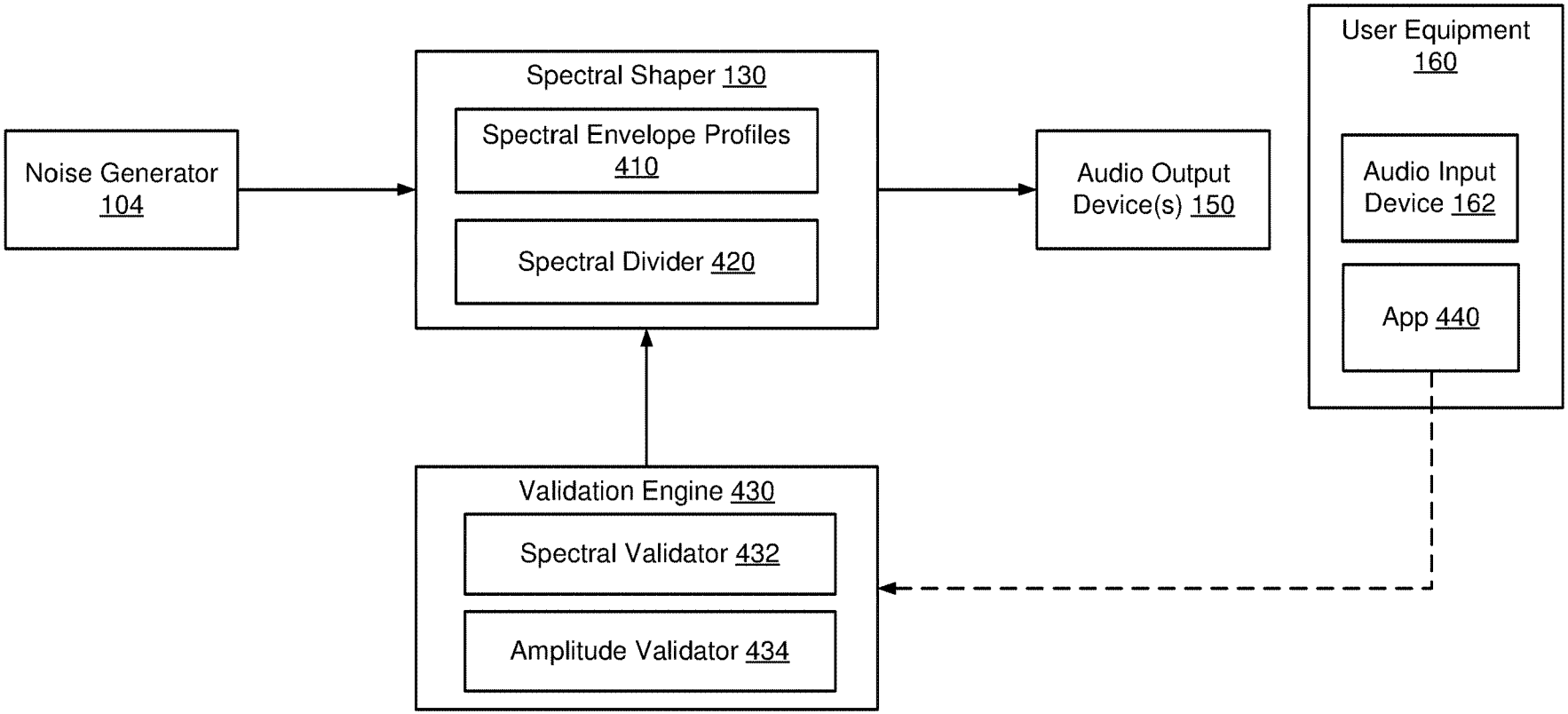

FIG. 4B is another simplified block diagram illustrating the sound shaping by various components utilizing a feedback loop, in accordance with some embodiments. For brevity, the same components described above with reference to FIG. 4A are not repeated herein. Different from the embodiments shown in FIG. 4A, the feedback loop includes an application 440 executed on the user equipment 160. The application 440 receives the audio signal outputted by the audio output device 150 of the active case 310 and captured by the audio input device 162 of the user equipment 160. The application 440 then measures the noise frequency response received by the user equipment 160. In some embodiments, the data from the application 440 is processed by the application 440 or exported to an external processor (e.g., online processing) or the spectral validator 432 of the active case 310, as indicated by the dotted line. The external processor or the application 440 then provides the processed data to the spectral shaper 130 for calibration, e.g., causing the spectral shaper 130 to adjust the frequency response as a function of the measurement data.

For example, along the audio-sealing pathway, components including the audio output devices 150, the audio coupling interface 152 (FIG. 1), and the audio input devices 162 on the user equipment 160 may have a combined frequency characteristics of Ha(f). The noise signals from the noise generator 104 may have a frequency characteristic of X(f), e.g., X=1 when the output is white noise or X=1/f when the output is pink noise, etc. Thus, for the user equipment 160 to receive desired noise frequency characteristics Y(f), in some embodiments, the validation engine 430 instructs the spectral shaper 130 to shape the noise signals, e.g., by applying a digital filter with frequency characteristics of Hs(f). In other words, Y(f) is a function of X(f), Hs(f), and Ha(f), e.g., Y(f)=X(f) Hs(f) Ha(f), where X(f) is the frequency characteristics of the noise signals from the noise generator 104, Hs(f) is the frequency characteristics of signals from the digital filter applied by the spectral shaper 130, and Ha(f) is the combined frequency characteristics associated with the audio-sealing pathway. In some embodiments, e.g., during calibration and/or factor test, the desired noise frequency characteristics Y(f) received by the user equipment 160 can be measured on the user equipment 160 (e.g., via the application 440) and provided as a feedback to the validation engine 430. The validation engine 430 can then instruct the spectral shaper 130 to set, adjust, or modify the digital filter Hs(f) as a function of Y(f), X(f), and Ha(f).

Using the validation engine 430 disclosed herein, the active case 310 balances the effectiveness of privacy protection and obtrusiveness. For example, in a quiet room, where the ambient sound level is low, it is obtrusive for the active case to output loud masking signal. On the other hand, when the ambient sound level is high, e.g., when people are yelling, it is necessary to increase the masking signal level in order to shield the loud conversation. Thus, through the validation engine 430, the active case 310 balances the effectiveness of privacy protection and obtrusiveness by varying the level of the audio jamming in accordance with the ambient sound level.

Figure 6:
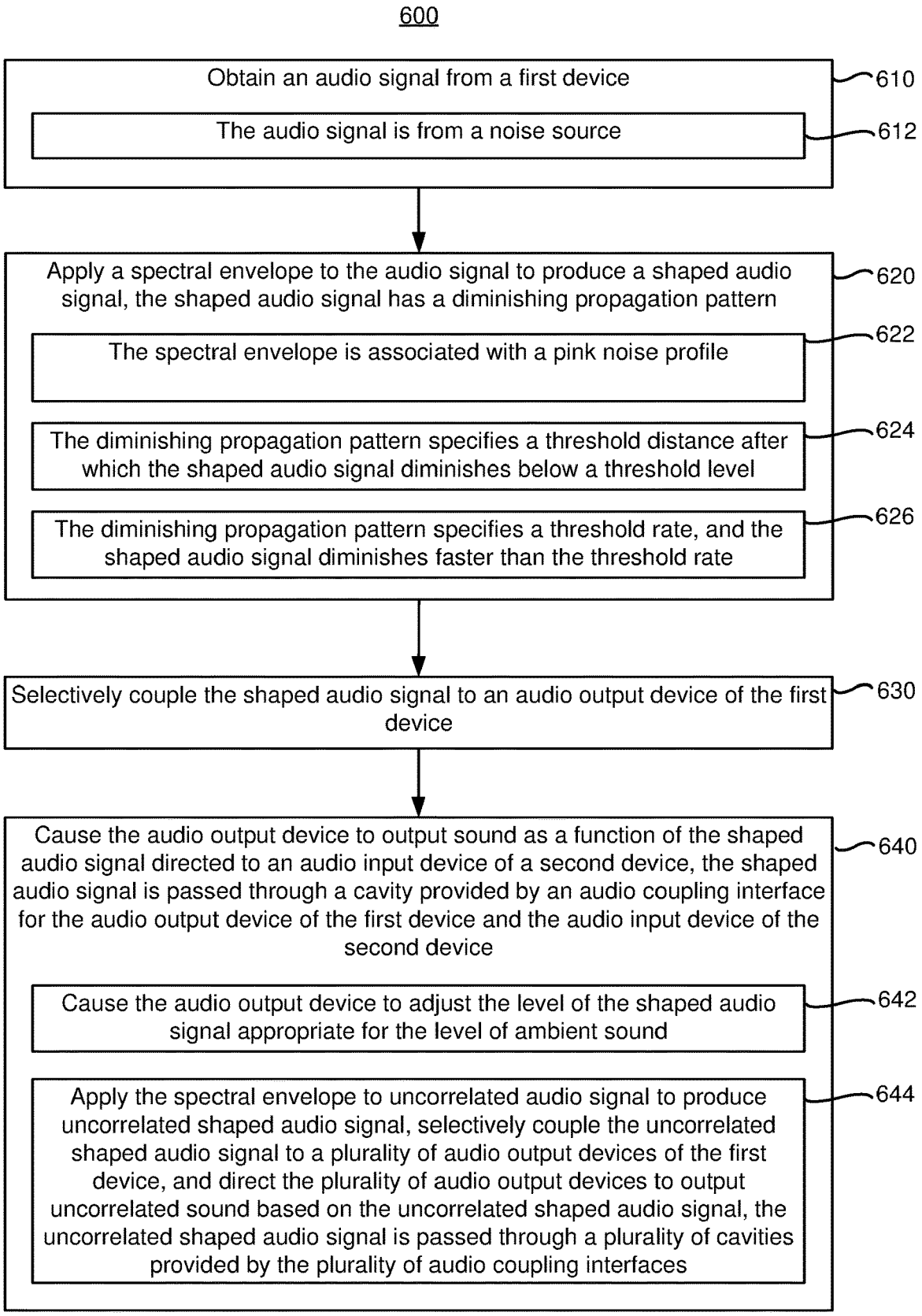
FIG. 6 is a flowchart illustrating a method for shaping audio signal in accordance with some embodiments.

FIG. 6 is a flowchart representation of a method 600 for shaping audio signal, in accordance with some embodiments. In some embodiments, the method 600 is performed at an apparatus (e.g., the active case 310 of FIG. 3) with a processor (e.g., the digital signal processor 320 of FIG. 3) and a non-transitory memory storing instructions for execution by the processor. Briefly, the method 600 includes applying a spectral envelope to shape an audio signal, e.g., the shaped audio signal has a diminishing propagation pattern. The shaped audio signal is selectively coupled to an audio output device of a first device, so that sound is outputted and directed to an audio input device of a second device protected by the first device. The shaped audio signal thus provides effective masking of the audio signal and is less obtrusive to the surroundings due to its diminishing propagation pattern.

To that end, as represented by block 610, the method 600 includes obtaining an audio signal (e.g., the audio signal from 110 from the microphone 102 and/or the noise generator 104 as shown in FIG. 1) from a first device (e.g., the active case 310). In some embodiments, the audio signal is provided by a noise source (e.g., the noise generator 104 as shown in FIG. 1). In some embodiments, the noise source provides a thermal noise. In some embodiments, the audio signal is provided by an audio input device, such as the microphone 102 shown in FIG. 1. In some embodiments, the audio signal is provided by the noise source and the audio input device.

As represented by block 620, in some embodiments, the method 600 includes applying a spectral envelope to the audio signal in order to produce a shaped audio signal, wherein the shaped audio signal has a diminishing propagation pattern. In some embodiments, as represented by block 622, the spectral envelope is associated with a pink noise profile. For example, a pink noise profile is characterized by lower the frequency components/content above certain frequency levels. The pink noise profile is desirable due to its low power consumption, effective masking, and less obtrusive or noticeable. An exemplary shaped audio signal generated by applying a pink noise profile is shown in FIG. 5D.

In some embodiments, the spectral envelope application includes splitting the audio signal into a plurality of frequency bands and adjusting at least one of the plurality of frequency bands in accordance with the spectral envelope in order to produce the shaped audio signal. As a result of shaping the frequency bands, the shaped audio signal has the diminishing propagation pattern when propagating.

For example, as represented by block 624, the diminishing propagation pattern specifies a threshold distance beyond which the shaped audio signal diminishes below a threshold level. Because low frequencies travel farther, by applying a spectral envelope to lower the level of low frequency bands between, for example, [F1, F2] as shown in FIG. 5B, the shaped audio signal travels a shorter distance and diminishes below a threshold level beyond a threshold distance.

In another example, as represented by block 626, the diminishing propagation pattern specifies a threshold rate and the shaped audio signal diminishes faster than the threshold rate. Because high frequencies are absorbed better than low frequencies, the amplitude of high frequency signals falls off faster. By applying a spectral envelope to lower the level of high frequency bands between, for example, [F2, F3] as shown in FIG. 5C, the shaped audio signal diminishes faster than a threshold rate.

As represented by block 630, in some embodiments, the method 600 includes selectively coupling the shape audio signal to an audio output device (e.g., the speaker 150) of the first device (e.g., the active case 310). For example, in one mode of operation, the shaped audio signal is the noise signal shaped from the noise provided by the noise generator 104. In such mode, the shaped noise signal is coupled to the speaker 150. In a different mode of operation, the shaped audio signal is generated by shaping the audio signal captured by the microphone 102 of the active case 310, e.g., by changing the frequency of the audio signal so that the voice sounds like a different person. In such embodiments, the modified voice signal is coupled to the speaker 150.

In some embodiments, as represented by block 640, the method 600 includes causing the audio output device (e.g., the speaker 150) to output sound as a function of the shaped audio signal directed to an audio input device (e.g., the microphone 162) of a second device (e.g., the user equipment 160). In such embodiments, the shaped audio signal is passed through a cavity provided by an audio coupling interface (e.g., the audio seal 152) for the audio output device (e.g., the speaker 150) of the first device (e.g., the active case 310 and the audio input device (e.g., the microphone 162) of the second device (e.g., the user equipment 160). In some embodiments, the cavity is formed by the audio coupling interface (e.g., the hole inside the wall of the audio seal 152 as shown in FIG. 2) connecting the audio output device (e.g., the speaker 150) of the first device (e.g., the active case 310) to the audio input device (e.g., the microphone 162) of the second device (e.g., the user equipment 160) in order to direct the shaped audio signal from the audio output device (e.g., the speaker 150) to the audio input device (e.g., the microphone 162).

In some embodiments, the method 600 includes estimating (e.g., by the envelope detector 322) a level of ambient sound in which the apparatus (e.g., the active case 310) is operating, determining (e.g., by the validation engine 430) whether or not a level of the shaped audio signal is appropriate for the level of ambient sound, and as represented by block 642, causing (e.g., by the validation engine 430) the audio output device to adjust the level of the shaped audio signal based on a determination that the level of the shaped audio signal is not appropriate for the level of ambient sound. The level of the shaped signal after the adjustment thus is appropriate for the level of ambient sound in order to balance the effectiveness of privacy protection and obtrusiveness.

In some embodiments, the audio signal includes uncorrelated audio signals. In such embodiments, as represented by block 644, the method 600 includes applying the spectral envelope to the uncorrelated audio signals to produce uncorrelated shaped audio signals, selectively coupling the uncorrelated shaped audio signals to a plurality of audio output devices (e.g., the speakers 150) of the first device (e.g., the active case 310), and directing the plurality of audio output devices (e.g., the speakers 150) to output uncorrelated sounds based on the uncorrelated shaped audio signals, wherein the uncorrelated shaped audio signals are passed through a plurality of cavities provided by the plurality of audio coupling interfaces (e.g., the cavities inside the seals 152) for the plurality of audio output devices (e.g., the speakers 150) of the first device (e.g., the active case 310) and the plurality of audio input devices (e.g., the microphones 162) of the second device (e.g., the user equipment 160). As such, the audio content recorded by the microphones 162 is uncorrelated, and it is more difficult to derive the protected audio content through elaborated efforts, such as by comparing the audio signal from different microphones 162.

The foregoing description, for purpose of explanation, has been described with reference to specific embodiments. However, the illustrative discussions above are not intended to be exhaustive or to limit the invention to the precise forms disclosed. Many modifications and variations are possible in view of the above teachings. The embodiments were chosen and described in order to best explain the principles of the invention and its practical applications, to thereby enable others skilled in the art to best use the invention and various described embodiments with various modifications as are suited to the particular use contemplated.

What is claimed is:

1. An apparatus comprising:

a noise generator operable to generate uncorrelated noise signal streams;

a spectral shaper, coupled to the noise generator and two or more audio output devices, operable to shape the uncorrelated noise signal streams to uncorrelated audio signal streams;

the two or more audio output devices arranged to output the uncorrelated audio signal streams directed to audio input devices of a second device;

two or more audio coupling interfaces, coupled to the two or more audio output devices and mateable with the audio input devices of the second device, wherein a respective audio coupling interface of the two or more audio coupling interfaces, when mated with a respective audio input device of the second device, is arranged to provide part of a respective audio-sealing pathway to pass a respective audio signal stream of the uncorrelated audio signal streams from a respective audio output device to the respective audio input device of the second device; and a housing arranged to hold the second device and at least partially support the noise generator, the two or more audio output devices, two or more audio coupling interfaces, and the spectral shaper.

2. The apparatus of claim 1, wherein the noise generator is further operable to generate the uncorrelated noise signal streams using a random seed.

3. The apparatus of claim 1, further comprising one or more audio input devices operable to record ambient sound.

4. The apparatus of claim 3, wherein the uncorrelated audio signal streams include shaped uncorrelated noise signal streams mixed with the ambient sound.

5. The apparatus of claim 3, further comprising an amplitude validator operable to cause the spectral shaper to adjust amplitudes of the uncorrelated audio signal streams according to an amplitude of the ambient sound.

6. The apparatus of claim 1, further comprising a validation engine coupled to the spectral shaper and the spectral shaper includes a digital filter, wherein the validation engine is operable to calibrate the digital filter by:

instructing the spectral shaper to apply the digital filter to the respective audio signal stream;

receiving feedbacks from the second device; and modifying characteristics of the digital filter based on characteristics of the respective audio-sealing pathway, the feedbacks from the second device, and frequency characteristics of a corresponding noise signal stream of the uncorrelated noise signal streams.

7. The apparatus of claim 6, wherein the characteristics of the respective audio-sealing pathway includes characteristics of the respective audio output device, characteristics of the respective audio input device of the second device, and characteristics of the respective audio coupling interface.

8. The apparatus of claim 6, wherein the validation engine is further operable to:

direct the second device to measure frequency characteristics of audio signals received by the audio input devices of the second device; and receive the frequency characteristics of the audio signals as the feedbacks.

9. The apparatus of claim 1, wherein the spectral shaper includes:

a spectral divider operable to split the two or more uncorrelated audio signal streams into a plurality of frequency bands; and a spectral selector, coupled to the spectral divider, operable to select at least one of the plurality of frequency bands for the spectral shaper to shape.

10. The apparatus of claim 1, wherein the respective audio coupling interface includes an audio seal defining a cavity as part of the respective audio-sealing pathway to allow passing of the respective audio signal stream from the respective audio output device to the respective audio input device of the second device.

11. A method comprising:

at an apparatus with a noise generator, a spectral shaper coupled to the noise generator and two or more audio output devices, the two or more audio output devices, two or more audio coupling interfaces coupled to the two or more audio output devices and mateable with audio output devices of a second device, and a housing arranged to hold the second device and at least partially support the noise generator, the two or more audio output devices, the two or more audio coupling interfaces, and the spectral shaper:

generating, by the noise generator, uncorrelated noise signal streams;

shaping, by the spectral shaper, the uncorrelated noise signal streams to uncorrelated audio signal streams; and outputting the uncorrelated audio signal streams directed to the audio input devices of the second device, including outputting a respective audio signal stream of the uncorrelated audio signal streams to pass through a respective audio-sealing pathway from a respective audio output device to the respective audio input device of the second device, wherein the respective audio-sealing pathway is formed at least in part by a respective audio coupling interface of the two or more audio coupling interfaces mating with a respective audio input device of the second device.

12. The method of claim 11, further comprising generating the uncorrelated noise signal streams using a random seed.

13. The method of claim 11, further comprising recording ambient sound by one or more audio input devices of the apparatus.

14. The method of claim 13, further comprising mixing the ambient sound with shaped uncorrelated noise streams to produce the uncorrelated audio signal streams.

15. The method of claim 13, further comprising adjusting amplitudes of the uncorrelated audio signal streams according to an amplitude of the ambient sound.

16. The method of claim 11, further comprising:

applying a digital filter to the respective audio signal stream;

receiving feedbacks from the second device; and modifying characteristics of the digital filter based on characteristics of the respective audio-sealing pathway, the feedbacks from the second device, and frequency characteristics of a corresponding noise signal stream of the uncorrelated noise signal streams.

17. The method of claim 16, wherein the characteristics of the respective audio-sealing pathway includes characteristics of the respective audio output device, characteristics of the respective audio input device of the second device, and characteristics of the respective audio coupling interface.

18. The method of claim 16, further comprising:

directing the second device to measure frequency characteristics of audio signals received by the audio input devices of the second device; and receive the frequency characteristics of the audio signals as the feedbacks.

19. The method of claim 11, further comprising:

splitting the two or more uncorrelated audio signal streams into a plurality of frequency bands; and selecting at least one of the plurality of frequency bands to shape.

20. The method of claim 11, wherein the respective audio coupling interface includes an audio seal defining a cavity as part of the respective audio-sealing pathway to allow passing of the respective audio signal stream from the respective audio output device to the respective audio input device of the second device.

* * * * *